US006065959A

United States Patent [19]

Tsai

[11] Patent Number: 6,065,959

[45] Date of Patent: May 23, 2000

[54] HANDY GAS TORCH

[76] Inventor: Chin-Lin Tsai, 3F, No. 94, Sec. 4, Chung Hsin Road, San Chung City, Taipei Hsien, Taiwan

[21] Appl. No.: 09/280,076

[22] Filed: Mar. 29, 1999

[51] Int. Cl.[7] ..... F23D 14/28

[52] U.S. Cl. ..... 431/255; 431/344; 126/406

[58] Field of Search ..... 431/344, 255; 126/414, 407, 405, 406

[56] References Cited

U.S. PATENT DOCUMENTS

| | | | |
|---|---|---|---|
| 4,804,324 | 2/1989 | Yoshinaga | 431/344 |
| 5,082,440 | 1/1992 | Yamamoto | 431/344 |
| 5,466,149 | 11/1995 | Tsai | 431/344 |
| 5,531,592 | 7/1996 | Tsai | 431/344 |
| 5,564,919 | 10/1996 | Tsai | 431/344 |

*Primary Examiner*—Carl D. Price
*Attorney, Agent, or Firm*—Dougherty & Troxell

[57] ABSTRACT

A handy gas torch includes a fuel container, a fuel gas control device, a piezoelectric device, a securing plate, a supporting frame, a burning, and a top cover. During operation, a knob of the fuel gas control device is turned so that fuel in the fuel container is drawn up by a suction tube of a gas supply device. The fuel gas passes through a tube neck of the fuel gas control device, a guide hole, a gas output tube to a fuel gas nozzle of the burning device and then fills a channel. By turning an adjusting knob to bring a knob hole into alignment with an air intake hole, air is induced into the channel to mix with the fuel gas. The fuel mixture is ejected by a fire nozzle of a fire ejecting device. Upon the user's pressing a press handle of the piezoelectric device to cause a boss on a press plate to press against a piezoelectric means, sparks are generated by a lead wire on one side of the fire nozzle to ignite the fuel mixture for burning purposes.

13 Claims, 7 Drawing Sheets

HANDY GAS TORCH

BACKGROUND OF THE INVENTION (a) Field of the Invention

The present invention relates to a burning device, more particularly to a gas torch that is simple and convenient to operate, that is quick to assemble, and that has high burning efficiency.

(b) Description of the Prior Art

Liquefied gas affords much facility in daily life. It can be used in cigarette lighters, portable gas stoves, etc. Besides, it is convenient to carry and store.

Due to the facility provided by liquefied gas, gas burners are generally available in the marketplace in two types. One form is taught in, for instance, U.S. Pat. No. 5,466,149 and U.S. Pat. No. 5,564,919 to the inventor of the present invention. Disclosed in the '919 patent is a containerized liquefied gas having a gas release valve at a top portion pivotally connected to a nozzle at a bottom portion of a heating torch so as to permit filling of liquefied gas into a fuel container adapted to supply fuel to an upper gas release device and a fire outlet device. The other type is taught in, for instance, U.S. Pat. No. 4,804,324 to Prince Industrial Development Co., Ltd. Disclosed in the '324 patent is a burner device that has a supporting and connecting device at a lower portion therefor for pivotal connection with commercially available containerized liquefied gas. The gas, after vaporization, supplies the entire burning device with the required fuel for purposes of melting, welding, etc.

In addition, both U.S. Pat. No. 5,082,440 and the inventor's another patent, i.e., U.S. Pat. No. 5,531,592, teach a handy gas torch in which a conventional cigarette lighter is used as a source of fuel that passes through a gas release device and a burning device, and a piezoelectric device is provided to ignite a mixture of the fuel and air.

As can be seen, they are many types of burning device with different applications to provide users with great facility.

SUMMARY OF THE INVENTION

A primary object of the present invention is to provide a handy gas torch.

According to the present invention, the handy gas torch includes a fuel container, a fuel gas control device, a piezoelectric device, a securing plate, a supporting frame, a burning, and a top cover. During operation, a knob of the fuel gas control device is turned so that fuel in the fuel container is drawn up by a suction tube of a gas supply device. The fuel gas passes through a tube neck of the fuel gas control device, a guide hole, a gas output tube to a fuel gas nozzle of the burning device and then fills a channel. By turning an adjusting knob to bring a knob hole into alignment with an air intake hole, air is induced into the channel to mix with the fuel gas. The fuel mixture is ejected by a fire nozzle of a fire ejecting device. Upon the user's pressing a press handle of the piezoelectric device to cause a boss on a press plate to press against a piezoelectric means, sparks are generated by a lead wire on one side of the fire nozzle to ignite the fuel mixture for burning purposes.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
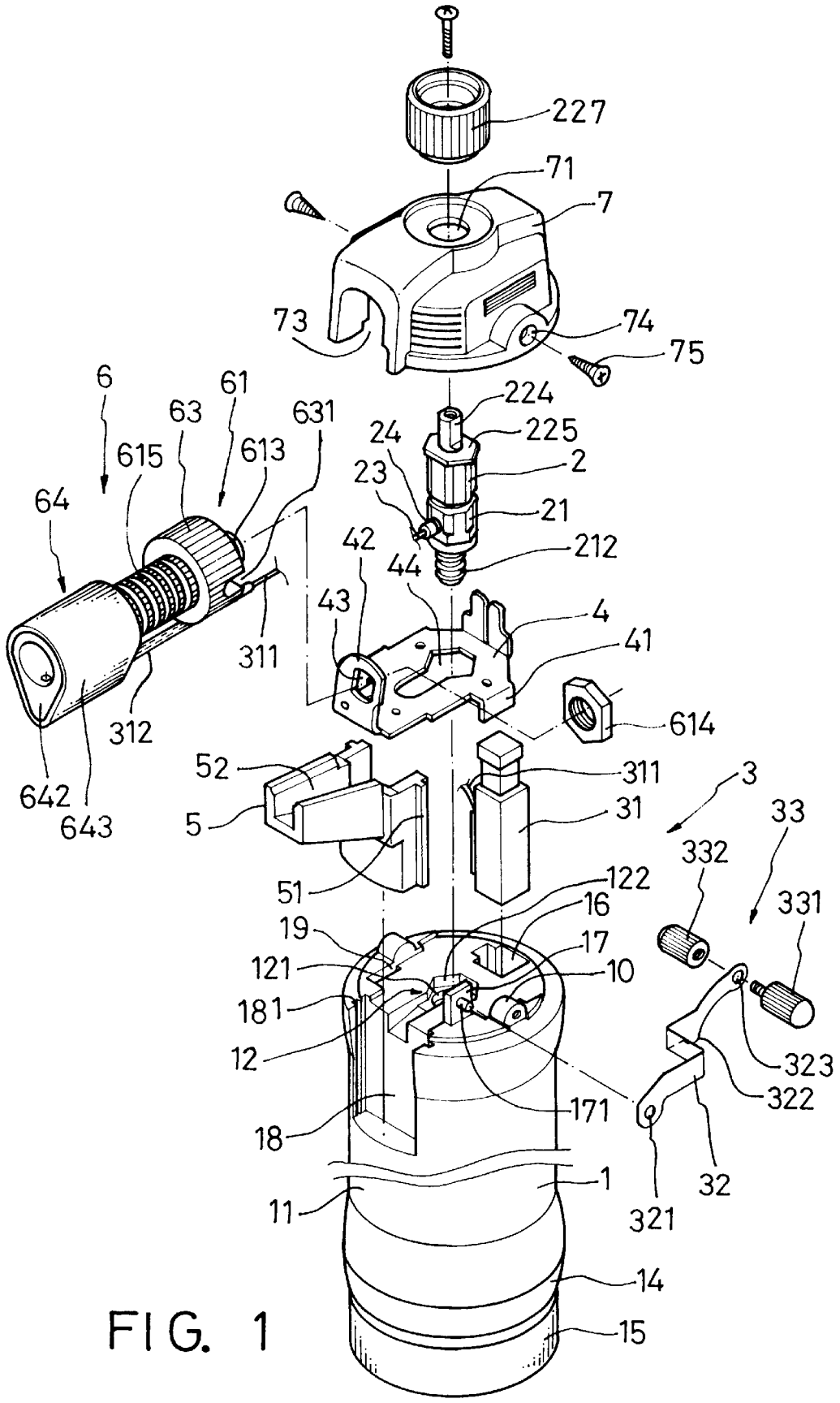
FIG. 1 is an exploded perspective view showing a majority of the structural elements of the present invention.

With reference to FIGS. 1 to 6, a gas torch according to the present invention is shown to comprise a fuel container 1, a fuel gas control device 2, a piezoelectric device 3, a securing plate 4, a supporting frame 5, a burning device 6, and a top cover 7.

Figure 2:
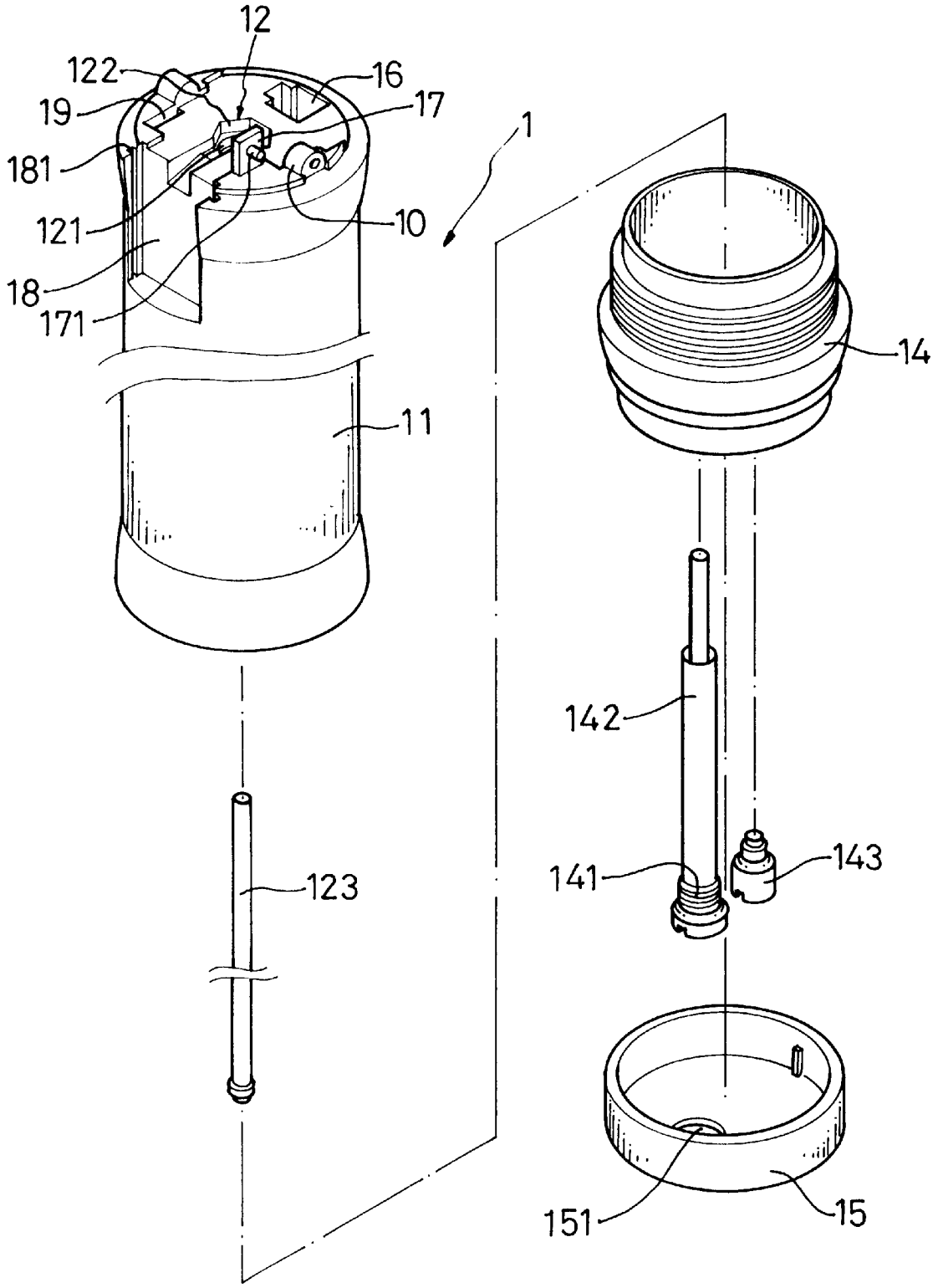
FIG. 2 is an exploded perspective view of a fuel container of the present invention.
Figure 5A:
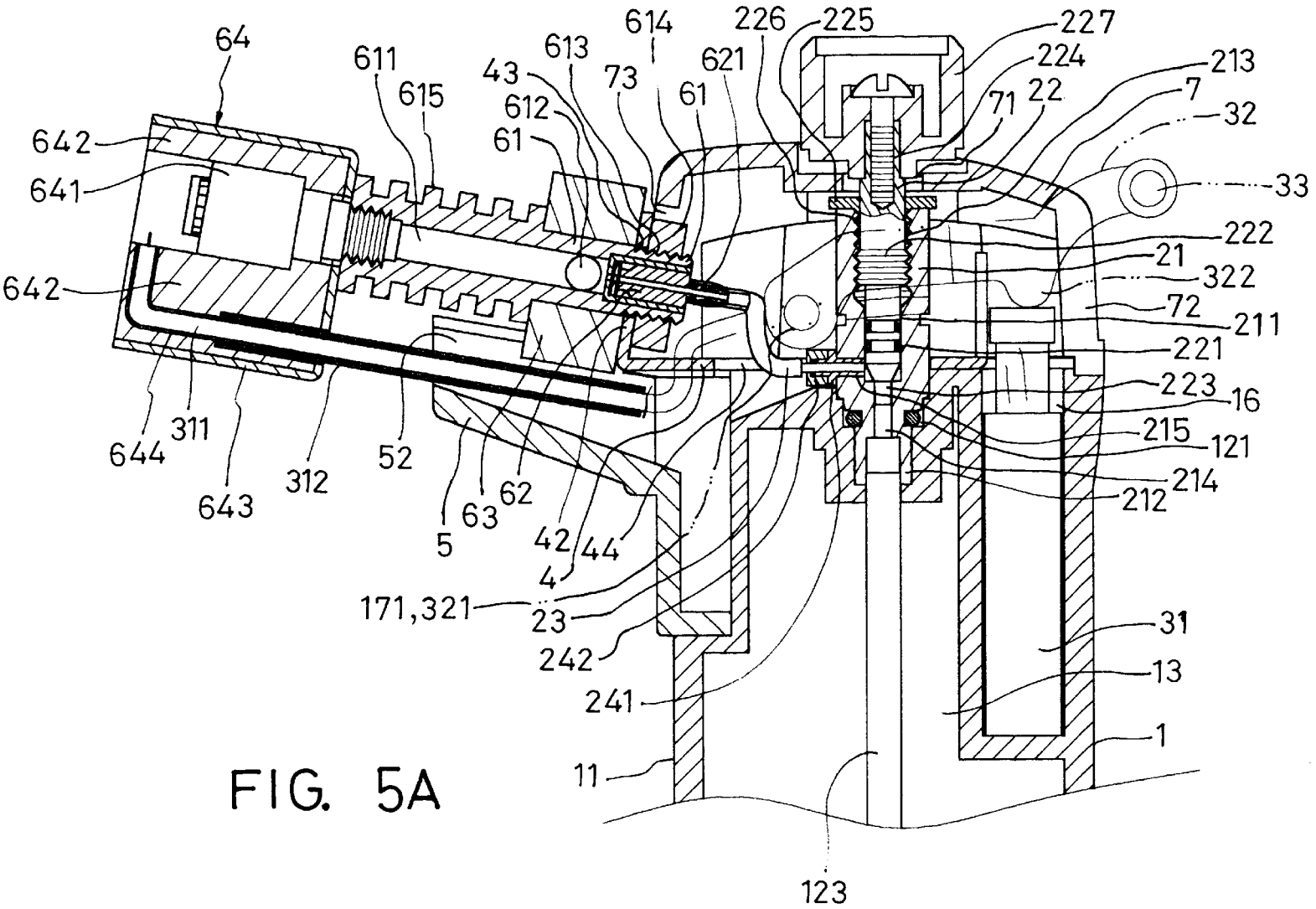
FIGS. 5A and 5B are front assembled sectional views of the present invention.
Figure 5B:
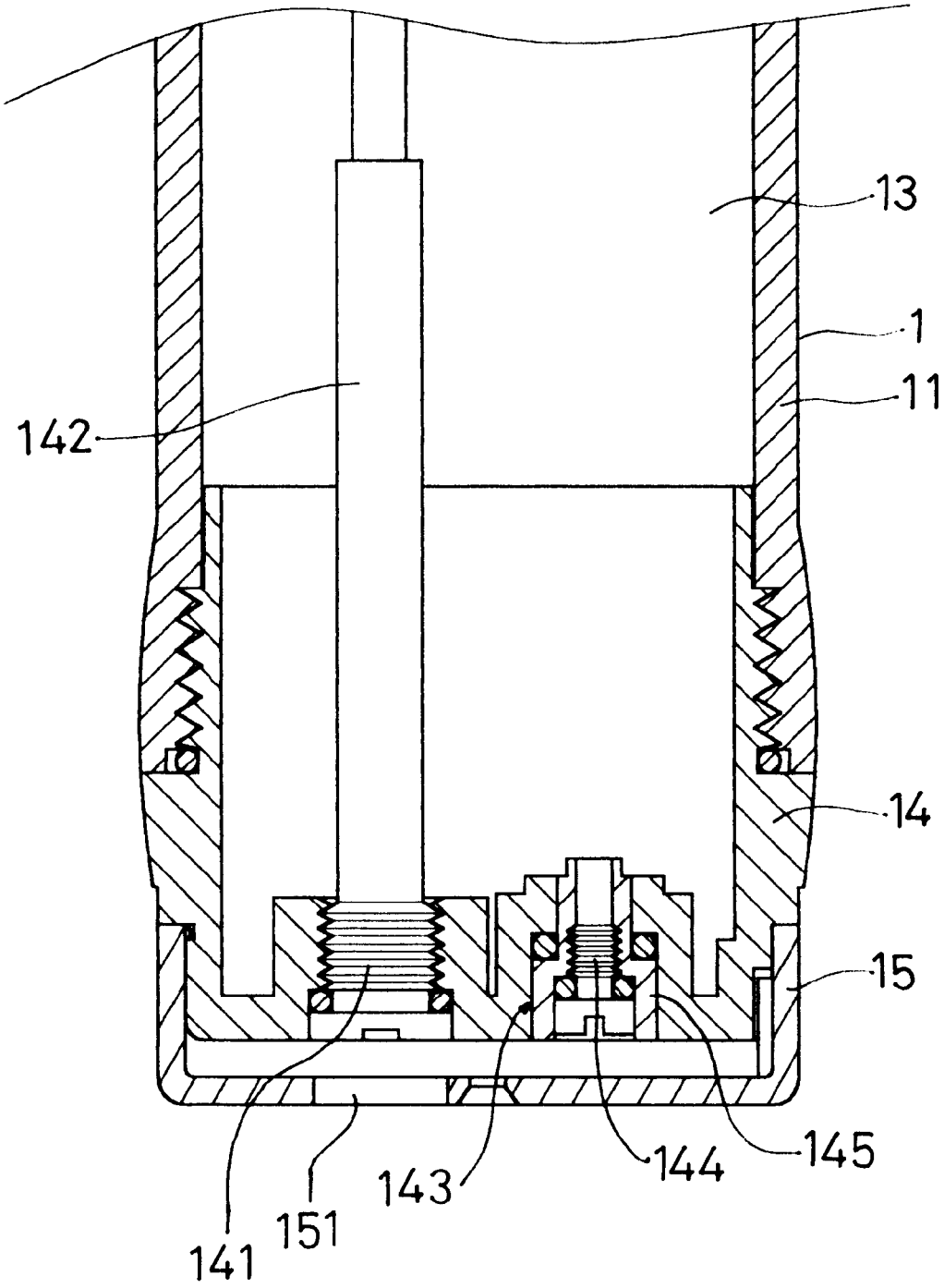
Figure 6:
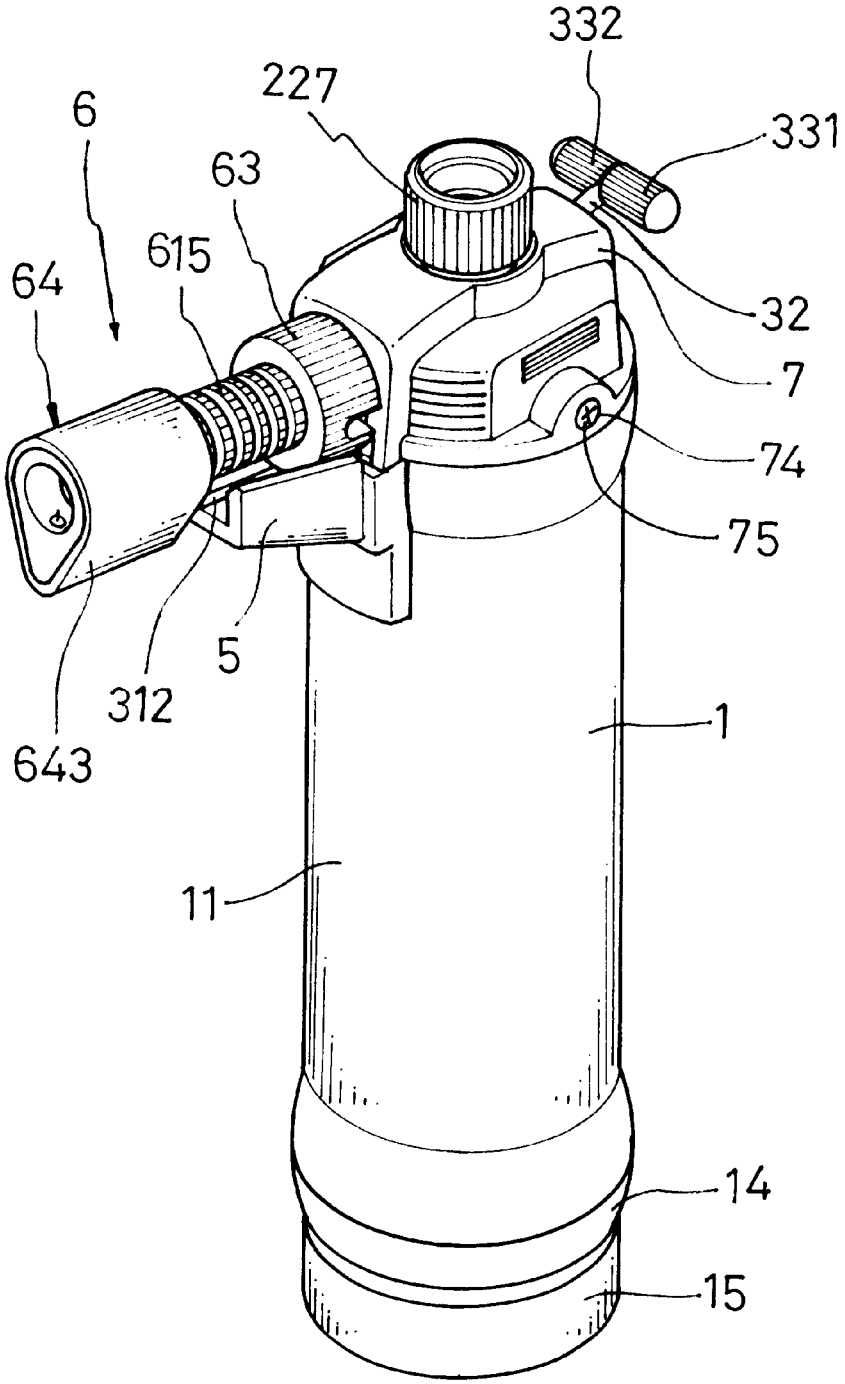
FIG. 6 is an assembled perspective view of the present invention.

Referring to FIGS. 1, 2 and 5B, the fuel container 1 includes a hollow fuel cylinder 11 adapted for storing fuel and transporting fuel gas to the burning device 6. The fuel cylinder 11 has a top portion provided with a gas supply device 12. The gas supply device 12 is provided with a cylinder hole 121 and an angled hole 122 on an outer side of the cylinder hole 121, adapted for insertion and positioning of the fuel gas control device 2. An intake tube 123 is additionally insertably provided in the cylinder hole 121 for introduction of fuel gas into the cylinder hole 121. The fuel cylinder 11 has a cylinder chamber 13 adapted for storing liquefied gas. A bottom portion of the fuel cylinder 11 is connected to a cylinder cover 14. The cylinder cover 14 has a bottom portion provided with a filling device 141 and a liquid inlet tube 142. In addition, one side of the filling device 141 is provided with a gas leakage device 143 that is connected to a gas relief device 143. The gas relief device 143 is screwably coupled thereto by utilizing a gas relief screw 144 and a gas relief valve 145. When the gas relief screw 144 and the gas relief valve 145 are lockably secured, fuel gas will not leak therefrom. When the fuel cylinder 11 of the present invention is filled with fuel and is being tested prior to delivery ex factory, in order to prevent possible danger of gas explosion during the course of transportation, the manufacturer may loosen the gas relief screw 144 so that the fuel leaks and vaporize and subsequently tighten the gas relief screw 144 and the gas relief valve 145.

In addition, the bottom portion of the cylinder cover 14 may be fitted with a bottom cover 15 that is formed with a bottom hole 151 in a position corresponding to that of the filling device 141 for passage of a connecting nozzle of the containerized liquefied gas therethrough to be connected to the filling device 141 to facilitate filling of fuel. An advantage in providing a bottom cover 15 is that the user is prevented from contacting the gas relief device 143 to avoid improper operation of the gas relief device 143.

Furthermore, a receiving groove 16 is additionally provided on one side of the cylinder hole 121 for receiving a piezoelectric means 31. A rib plate 17 is provided on the other side of the cylinder hole 121, and has an axial post 171 extending from a lateral side thereof for pivotal connection with a press plate 32. A front portion of the cylinder hole 121 is depressed to form an insert connecting device 18 with a retaining channel 181 provided on either side thereof along a longitudinal direction for insertion of and receiving the supporting frame 5. The top portion of the fuel cylinder 11 is provided with two or more retaining grooves 19 for retaining the securing plate 4. In addition, two threaded locking portions 10 project from opposite ends of the top portion of the fuel cylinder 10 for lockable connection with the top cover 7.

Figure 3:
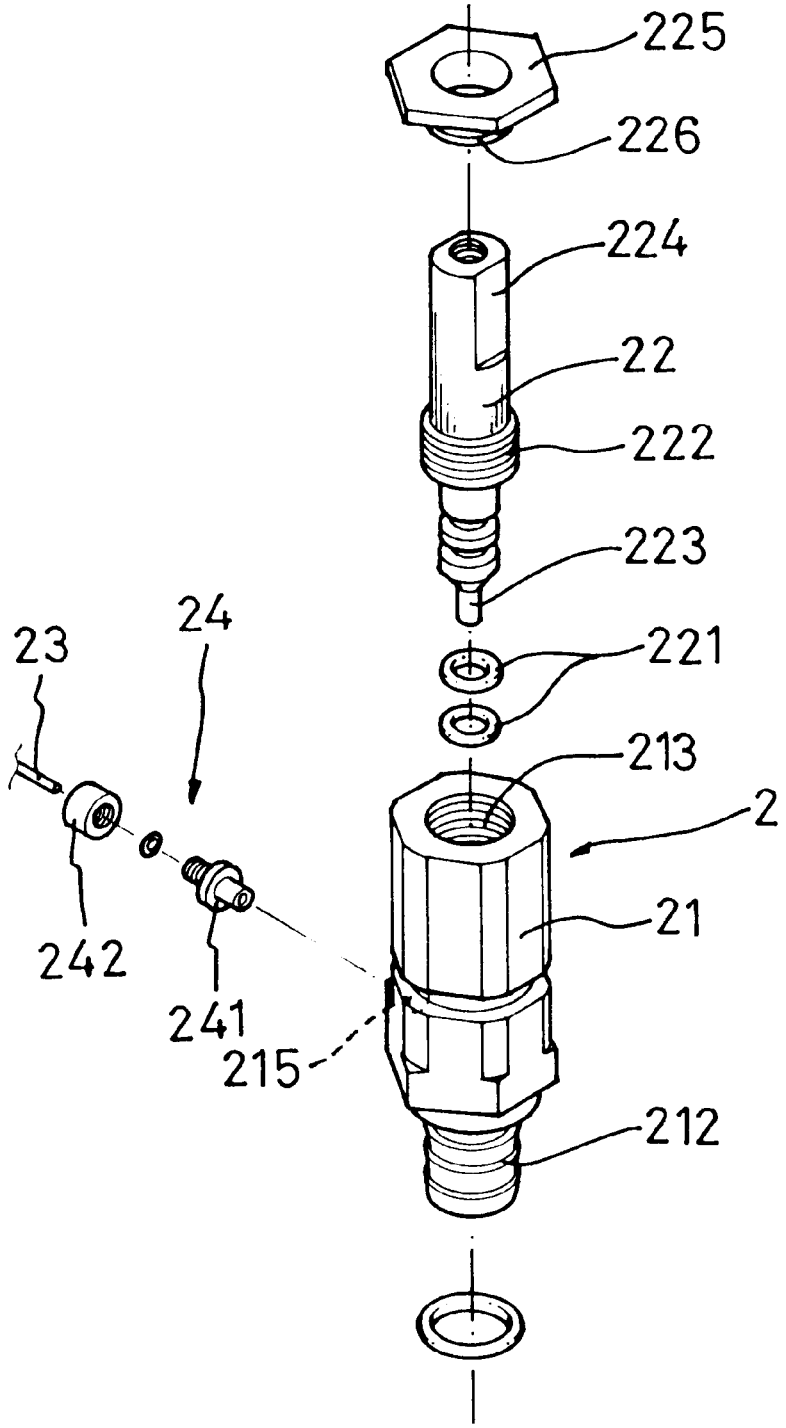
FIG. 3 is an exploded perspective view of a fuel control device of the present invention.

Referring to FIGS. 1, 3 and 5A, the fuel control device 2 is a valve that includes a polygonal valve seat 21 having a stepped hole 211 formed therein and a connecting tube 212 provided at one end of an outer side thereof for insertion into and pivotal connection with the cylinder hole 121 so as to permit introduction of the fuel gas into the stepped hole 211. The stepped hole 211 has two ends respectively provided with a threaded portion 213 and a tube neck 214, respectively, for screwable coupling with a control rod 22. Two leakage-stopping rings 221 are fitted onto a lower portion of the control rod 22, and an intermediate threaded section 222 of the control rod 22 screwably engages the threaded portion 213 of the valve seat 21. When the control rod 22 rotates inside the valve seat 21, a rod post 223 at the lower portion relative to the tube neck 214 will displace to a closed position or an open position to disconnect or connect fuel gas. Additionally, a rod end 224 at a top end of the control rod 22 pass through a sealing cover 225 that has a lower threaded portion 226 also engages the threaded portion 213 of the valve seat 21 to prevent slippage of the control rod 22 from the valve seat 21. The rod end 224 is further connected to a knob 227. In addition, the valve seat 21 is laterally provided with a guide hole 215 that is pivotally connected to a gas output tube 23 to facilitate transfer of fuel gas to the burning device 6. The gas output tube 23 passes through a connecting seat 24 and is coupled therewith. The connecting seat 24 has an engaging tube 241 insertably connected with the guide hole 215 before being screwably coupled with a tube cover 242, whereby the gas output tube 23 can be fixedly provided on one side of the valve seat 21.

The piezoelectric device 3 includes the above-mentioned piezoelectric means 31 that is disposed in the receiving groove 16. The piezoelectric means 31 has a lead wire 311 extending to the burning device 6. The above-mentioned press plate 32 is a strip or plate with multiple bends, and has a connecting hole 321 at one end for receiving the post 171, a boss 322 in a position to correspond to the piezoelectric means 31, and a press end portion 323 at the other end. When the press end portion 323 of the press plate 32 is pressed, the press plate 32 moves downwardly with the post 171 as axis. At this point, the boss 322 will press against the piezoelectric means 31 to cause an exposed end of the lead wire 311 to generate sparks to ignite the mixture of fuel gas. In order to facilitate the user's operation, a press handle 33 may be connected to both sides of the press end portion 323. The press handle 33 includes a right post 331 and a left post. The right post 331 passes through the press end portion 323 to be lockably connected with the left post 332. In addition, in order to protect the lead wire 311, the portion that is exposed on the fuel cylinder 11 is fitted with a protective tube 312.

The securing plate 4 is a bent plate and has extension plates 41 bending and extending downwardly therefrom to correspond to the retaining grooves 19 on the top portion of the fuel cylinder 11 and to insertably engage therewith. The securing plate 4 has a front plate portion 42 bending upwardly therefrom, the front plate portion 42 being provided with a hole 43 for connection with the burning device 6. The securing plate 4 further has a through hole 44 formed in a position corresponding to that of the fuel gas control device 2 for passage of the latter. Preferably, the front plate portion 42 of the securing plate 4 is obliquely disposed to allow oblique arrangement of the burning device 6 to thereby facilitate the user's operation.

The supporting frame 5 is an inverted L-shaped structure that is provided with ribs 51 in positions corresponding to those of the retaining channels 181 for insertion therein. A frame groove 52 extends obliquely from a front portion of the supporting frame 5 for straddling of the burning device 6 as well as passage and protection of the lead wire 311.

Figure 4:
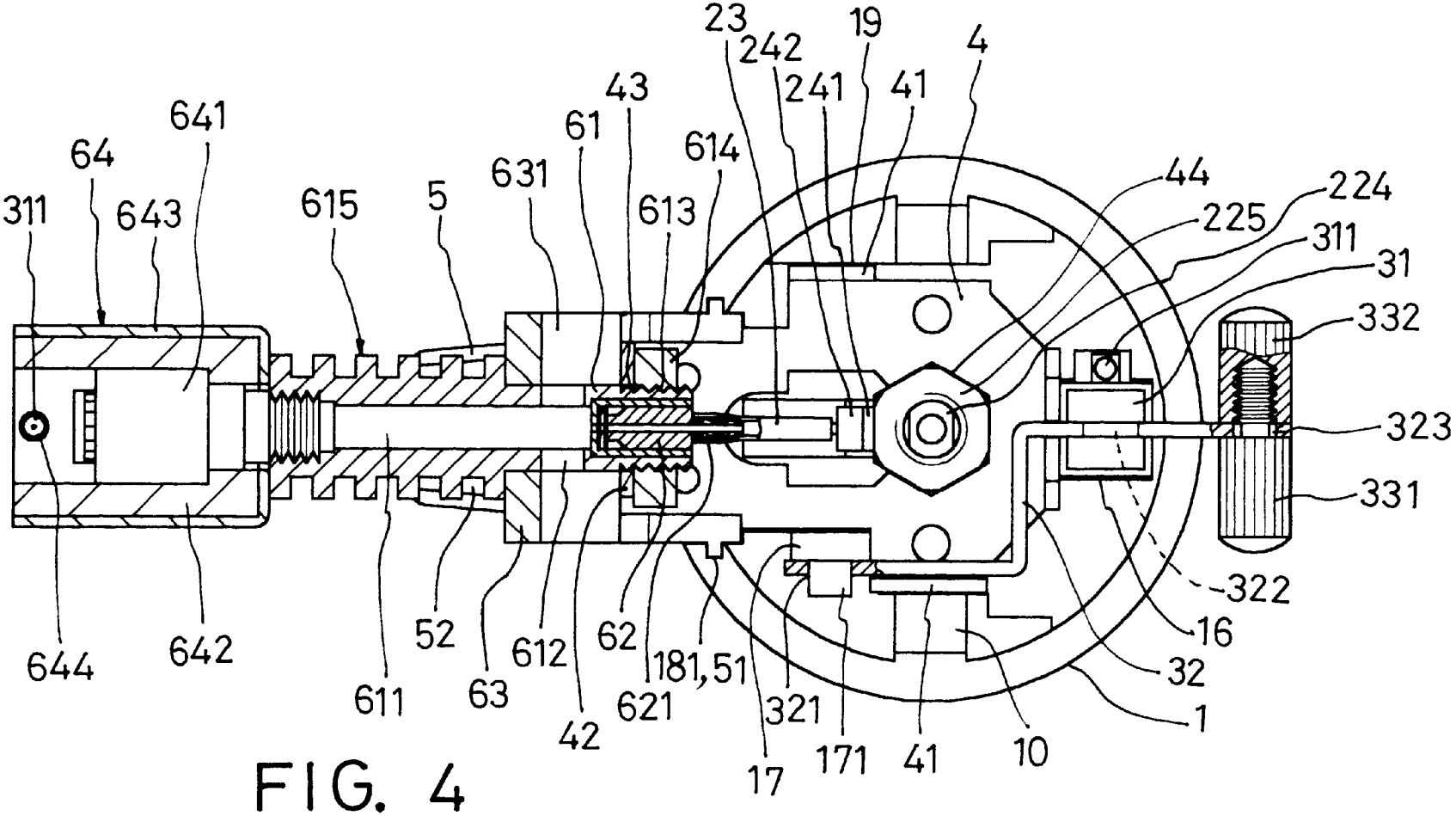
FIG. 4 is a top assembled sectional view of the present invention.

With reference to FIGS. 1, 4 and 5A, the burning device 6 mainly receives the fuel gas transferred from the fuel gas control device 2 and receives the lead wire 311 that passes through. The burning device 6 includes a connecting duct 61 that is internally provided with a straight channel 611. A through intake hole 612 is provided at a suitable position. A fuel gas nozzle 62 is inserted into a rear end of the channel 611, with the other end extending to form a toothed tube 621 for connection with the fuel output tube 23 to facilitate introduction of fuel gas into the fuel gas nozzle 62. In addition, a rear end of the connecting duct 61 is provided with a threaded end portion 613 for threaded engagement with a nut 614 after passing through the hole 43 of the securing plate 4 so that the entire burning device 6 can be secured on one side of the securing plate 4. In addition, an adjusting knob 63 is fitted between the threaded end portion 613 and a heat dissipating post 615. The adjusting knob 63 is provided with a knob hole 631 in a position corresponding to that of the intake hole 612, whereby when the adjusting knob 63 is turned to bring the knob hole 631 and the intake hole 612 into alignment, air is induced into the channel 611 to mix with the fuel gas inside the channel to form a fuel mixture of fuel and air. Finally, a fire nozzle 641 of a fire ejecting device 64 passes through a heat insulating sleeve 642 and a hood 643 to be pivotally connected to the channel 611 so that the fuel mixture can be ejected from a front end of the fire nozzle 641. The lead wire 311 also passes through a sleeve hole 644 of the heat insulating sleeve 64 to be secured on one side of the fire nozzle 64 to ignite the fuel mixture.

The top cover 7 is connected to the top portion of the fuel cylinder 11 to shield the elements thereon. The top cover 7 is provided with a top hole 71, a press recess 72, and a front hole 73 in positions corresponding to those of the fuel gas control device 2, the piezoelectric device 3, and the burning device 6 for extension thereof. Screws 75 pass through cover holes 74 formed to correspond to the locking portions 10 to lock the top cover 7 to the fuel cylinder 11.

Referring to FIGS. 1 to 6, during operation, the knob 227 is turned so that a suction tube 123 draws up fuel inside the fuel container 1. The fuel passes through the tube neck 214, guide hole 215, gas output tube 23, and fuel nozzle 62 to fill the channel 611. By turning the adjusting knob 63 to bring the knob hole 631 into alignment with the intake hole 612, air enters the channel 611 to mix with the fuel, and the mixture is ejected via the fire nozzle 641 of the fire ejecting device 64. At this point, the user can press the press handle 33 so that the boss 322 of the press plate 32 press against the piezoelectric means 31, thereby causing the lead wire 311 on one side of the fire nozzle 641 to generate sparks that ignite the fuel mixture to allow operations such as welding, melting, etc.

After completion of the operation, it is only necessary to turn the knob 227 so that the rod post 223 displaces to close the tube neck 214 to stop supply of fuel gas so that the fire extinguishes.

The present invention provides a number of advantages. Residual fuel in the fuel cylinder can be released to avoid possible gas explosion during transportation. The fuel cylinder and the cylinder cover can be injection molded to reduce manufacturing costs. Assembly is also convenient. The elements of each unit can be pre-assembled, and the units can be later assembled to the fuel container. Besides, the arrangement of the bottom cover can prevent the user from operating the gas relief device to ensure safety. Furthermore, the burning device allows a concentrated flame that enables quick heating to achieve high burning efficiency.

Although the present invention has been illustrated and described with reference to the preferred embodiment thereof, it should be understood that it is in no way limited to the details of such embodiment but is capable of numerous modifications within the scope of the appended claims.

What is claimed is:

1. A handy gas torch comprising:

a fuel container including a hollow fuel cylinder adapted for storing fuel and having a top portion and a bottom portion, a cylinder cover being provided on said bottom portion, said cylinder cover being provided with a filling device and a gas relief device, said top portion being provided with a gas supply device with a fuel gas control device, said gas supply device having a rib plate, said rib plate having an axial post extending laterally therefrom, a receiving groove being provided on a top side of said fuel cylinder at one end with an insert connecting device formed at the other end, said top side being provided with at least two retaining grooves and opposed locking portions;

a fuel gas control device, comprising a valve having one end inserted into said gas supply device and being adapted to receive fuel gas transported from said fuel container, the fuel gas control device having a control rod for controlling and adjusting the amount of fuel gas passing through said fuel gas control device and guided into a burning device by a gas output tube;

a piezoelectric device including piezoelectric means disposed in said receiving groove and having a lead wire extending therefrom, a press plate having a plurality of bends and a connecting portion being connected with said axial post, a boss on a bottom potion of said press plate being located on said piezoelectric means to be in contact therewith, said press plate further having a press end portion extending outwardly;

a securing plate having extension plates extending downwardly therefrom to engage said retaining grooves, a front plate portion having a plate hole, and a through hole through which said fuel gas control device extends;

a substantially inverted L-shaped supporting frame connected to said insert connecting device, said supporting frame having a frame groove extending obliquely from a front portion thereof for straddling of said burning device and for passage of said lead wire from said piezoelectric device;

a burning device receiving fuel gas from said fuel gas control device and having a connecting duct internally provided with a channel, said channel having a rear end receiving a fuel gas nozzle connected with said gas output tube for introduction of fuel gas, said connecting duct having an outer rear threaded end portion adapted to pass through said plate hole to be locked with a nut, an adjusting knob being disposed between said threaded end portion and a heat dissipating post, said adjusting knob being provided with a knob hole, whereby when said knob hole and an intake hole in said channel are aligned, air enters said channel to mix with the fuel gas, the fuel mixture being ejected from a fire ejecting device connected thereto at a front end of said channel, said lead wire being provided on one side of said fire ejecting device, whereby when said press plate is pressed against said piezoelectric means, sparks are generated between said lead wire and said fire ejecting device to ignite the fuel mixture; and a top cover having cover holes corresponding to said locking portions for passage of screws therethrough to lockably secure said top cover to said locking portions, said top cover being further provided with a top hole, a press recess, and a front hole for extension of said fuel gas control device, said piezoelectric device, and said burner device therethrough, respectively.

2. The handy gas torch as defined in claim 1, wherein said gas relief device includes a gas relief valve on said cylinder cover and connected to a gas relief valve via a gas relief screw, whereby residual gas in said fuel container can be released when said gas relief screw is loosened.

3. The handy gas torch as defined in claim 1, wherein said fuel cylinder and said cylinder cover are threadably connected.

4. The handy gas torch as defined in claim 1, wherein said cylinder cover has a bottom portion with a bottom cover formed with a bottom hole corresponding to said filling device to facilitate the filling of fuel and prevent inadvertent contact with said gas relief device.

5. The handy gas torch as defined in claim 1, wherein said gas supply device includes a cylinder hole and an angled hole on an outer side of said cylinder hole for mounting of a valve seat of said fuel control device, said cylinder hole having a bottom portion with a suction tube for introduction of fuel gas into said cylinder hole.

6. The handy gas torch as defined in claim 5, wherein said fuel gas control device comprises: a polygonal valve seat having a stepped hole formed therein and a connecting tube at one end of an outer side thereof for connection with said cylinder hole so as to permit introduction of fuel gas into said stepped hole, and a control rod, whereby when said control rod rotates in said valve seat, a rod post at a lower end of said control rod moves relative to said valve seat to open or close a tube neck in said stepped hole so that the fuel gas is output through a guide hole formed in a lateral side of said valve seat, said control rod having a rod end at the other end passing through a sealing cover coupled with an opening end of said stepped hole, said rod end being further connected to a knob for controlling flow of fuel gas.

7. The handy gas torch as defined in claim 6, wherein said gas output tube passes through and is connected to a connecting seat such that one end of said gas output tube is secured in said guide hole.

8. The handy gas torch as defined in claim 7, wherein said connecting seat includes an engaging tube connected to a tube cover, said engaging tube being inserted into said guide hole.

9. The handy gas torch as defined in claim 1, wherein said press end portion of said press plate is connected to a press handle that is substantially perpendicular thereto, said press handle including a right post that passes through said press end portion to be coupled with a left post.

10. The handy gas torch as defined in claim 1, wherein said lead wire of said piezoelectric means is fitted with a protective tube on the outside of said fuel container.

11. The handy gas torch as defined in claim 1, wherein said front plate portion of said securing plate is obliquely disposed.

12. The handy gas torch as defined in claim 1, wherein said fire ejecting device includes a fire nozzle that passes through a heat insulating sleeve and is connected to said channel of said connecting duct, said heat insulating sleeve having a hood, said lead wire of said piezoelectric means passing through a sleeve hole of said heat insulating sleeve and secured on one side of said fire nozzle.

13. The handy gas torch as defined in claim 1, wherein said insert connecting device has two retaining channels and wherein said supporting frame has ribs inserted into said retaining channels.

* * * * *